US005887790A

United States Patent [19]

Flinn

[11] Patent Number: 5,887,790

[45] Date of Patent: Mar. 30, 1999

[54] UNIT INJECTOR HAVING A CAVITATION PRESSURE CONTROL MECHANISM

[75] Inventor: Michael A. Flinn, East Peoria, Ill.

[73] Assignee: Caterpillar Inc., Peoria, Ill.

[21] Appl. No.: 745,015

[22] Filed: Nov. 7, 1996

[51] Int. Cl.[6] ..... F02M 45/00

[52] U.S. Cl. ..... 239/5; 239/88; 239/90; 239/95; 239/533.4

[58] Field of Search ..... 239/5, 88, 90, 239/93, 95, 533.1, 533.2, 533.3, 533.4, 533.5, 533.9

[56] References Cited

U.S. PATENT DOCUMENTS

| | | | |
|---|---|---|---|
| 1,155,266 | 9/1915 | Pasel . | |
| 2,084,057 | 2/1937 | French | 239/90 |
| 2,097,241 | 10/1937 | Richards et al. | 299/107.6 |
| 2,126,623 | 8/1938 | Dow | 299/107.4 |
| 3,351,288 | 11/1967 | Perr | 239/89 |
| 3,425,635 | 2/1969 | Guertler | 239/453 |
| 3,544,008 | 12/1970 | Reiners | 239/90 |
| 4,187,060 | 2/1980 | Ellis et al. | 417/490 |
| 4,618,095 | 10/1986 | Spoolstra | 239/93 X |
| 5,292,072 | 3/1994 | Rix et al. | 239/533.3 |
| 5,299,738 | 4/1994 | Genter et al. | 239/95 X |
| 5,326,034 | 7/1994 | Peters | 239/90 |
| 5,611,317 | 3/1997 | Peters et al. | 239/95 X |

FOREIGN PATENT DOCUMENTS

| | | | |
|---|---|---|---|
| 0263807 | 9/1987 | European Pat. Off. | F02M 59/44 |
| 2215787 | 2/1989 | United Kingdom | F16J 15/56 |
| 2275739 | 2/1994 | United Kingdom | F02M 45/06 |

*Primary Examiner*—Andres Kashnikow
*Assistant Examiner*—Robin O. Evans
*Attorney, Agent, or Firm*—Eric M. Bram; Joseph W. Kern

[57] ABSTRACT

A fuel injector comprises a barrel, a plunger, and a port. The plunger is disposed in a bore in the barrel such that it intersects the port disposed in the barrel. The plunger has an injection rate shaping device and a cavitation control device disposed therein. The pressure control device is in such a position on the plunger such that subsequent to the rate shaping device passing fluidly communicating with the port, the cavitation control device aligns with the port to control the pressure wave propagated through the port by the termination of rate shaping.

11 Claims, 5 Drawing Sheets

UNIT INJECTOR HAVING A CAVITATION PRESSURE CONTROL MECHANISM

TECHNICAL FIELD

The present invention relates generally to fuel injection systems and, more particularly, to mechanisms for controlling cavitation pressures in the fuel injectors of such systems.

BACKGROUND ART

Fuel injection systems are used on various engines to ensure not only reliable fuel delivery, but also to provide the flexibility of rate shaping to reduce emissions and noise levels. U.S. Pat. No. 5,492,098 issued to Hafner et al. on Feb. 20, 1996 shows a Hydraulically-Actuated Electronically-Controlled (HEUI) fuel system with a fuel injection rate shaping device that interrupts the flow of fuel injected during an injection cycle by spilling fuel from a high pressure fuel chamber in communication with an injector nozzle. The spilling is in response to aligning an opening in a slidable plunger with a port in a housing within which the plunger reciprocates.

While this design provides rate shaping, in some instances the injector's structural components are adversely affected by pressure waves induced by alternate high pressure fuel spillage and fuel flow obstruction. The initial spill of high pressure fuel from a chamber through an opening in the plunger into the port sends the fluid at a high velocity into the stationary port. As the plunger continues its motion, the opening moves out of alignment with the port and the spill is rapidly shut off. These operating dynamics may result in cavitation which causes structural wear of the components, primarily at the sharp intersection corners of the port and a bore and on the plunger itself as it moves past the port opening.

U.S. Pat. No. 5,292,072 issued to Rix et al. on Mar. 8, 1994, addresses the issue of high pressure fluids inducing wear at the intersection of two bores at a sharp edge, having a very small radius. Here, a method for machining such intersections to have a greater radius at the intersection point is discussed. However, such an approach in the rate shaping device of a fuel injector may undesirably reduce the rapidity with which fuel spill can be initiated and terminated to preserve sharp injection rate shaping that is essential to achieving lower emissions levels.

The present invention is directed to overcoming one or more of the problems as set forth above.

DISCLOSURE OF THE INVENTION

In one aspect of the present invention there is disclosed a fluid pumping apparatus having a barrel, a reciprocatable plunger and a fluid. The barrel has a port and a bore with intersecting axes. The port contains a fluid and the bore has the reciprocatable plunger with an opening disposed therein. The fluid in the port has a pressure wave propagated through it and the plunger moves within the bore allowing the plunger opening to align with the port at such a time when the pressure wave propagates to the intersection of the port and bore.

In another aspect of the invention there is disclosed a fuel injector comprising a barrel with a bore therein. The bore has a longitudinal axis and a plunger reciprocatably and sealingly positioned in the bore and having a first opening and a compression end located a predetermined axial distance from each other. The compression end and bore define a compression chamber. The barrel also has a port disposed therein with a spill end opening into the bore. The plunger includes a regulating means, located axially from the compression end, for controlling pressure spikes at the spill end of the port.

In another aspect of the invention there is disclosed a method for injecting fuel with a fuel injector. The fuel injector has a barrel, a plunger, a fuel and a compression chamber. The barrel has a port and a bore with a longitudinal axis. The plunger has a compression end, and an actuation end, a first and second opening, and is reciprocatable and sealingly disposed in the bore with the first and second openings being axially spaced apart between the actuation end and compression end. The port has a spill end and is fluidly communicatable with the bore. The compression chamber is defined by the compression end of the plunger and the bore. The method comprises the steps of moving the plunger at a predetermined rate, towards the compression chamber and transmitting a fuel from the compression chamber into the spill end of the port, while the first opening of the plunger is communicating with the spill end, known as the first position. The communication is followed by blocking the fluid transmission to the spill end while the plunger continues in the same direction moving the first opening out of communication with the spill end, the second position. The plunger continues in the same direction and the blockage is followed by transmitting fluid between the spill end and the second opening in response to the second opening and the spill end being in fluid communication, the third position.

DETAILED DESCRIPTION OF PREFERRED EMBODIMENTS

Figure 1:
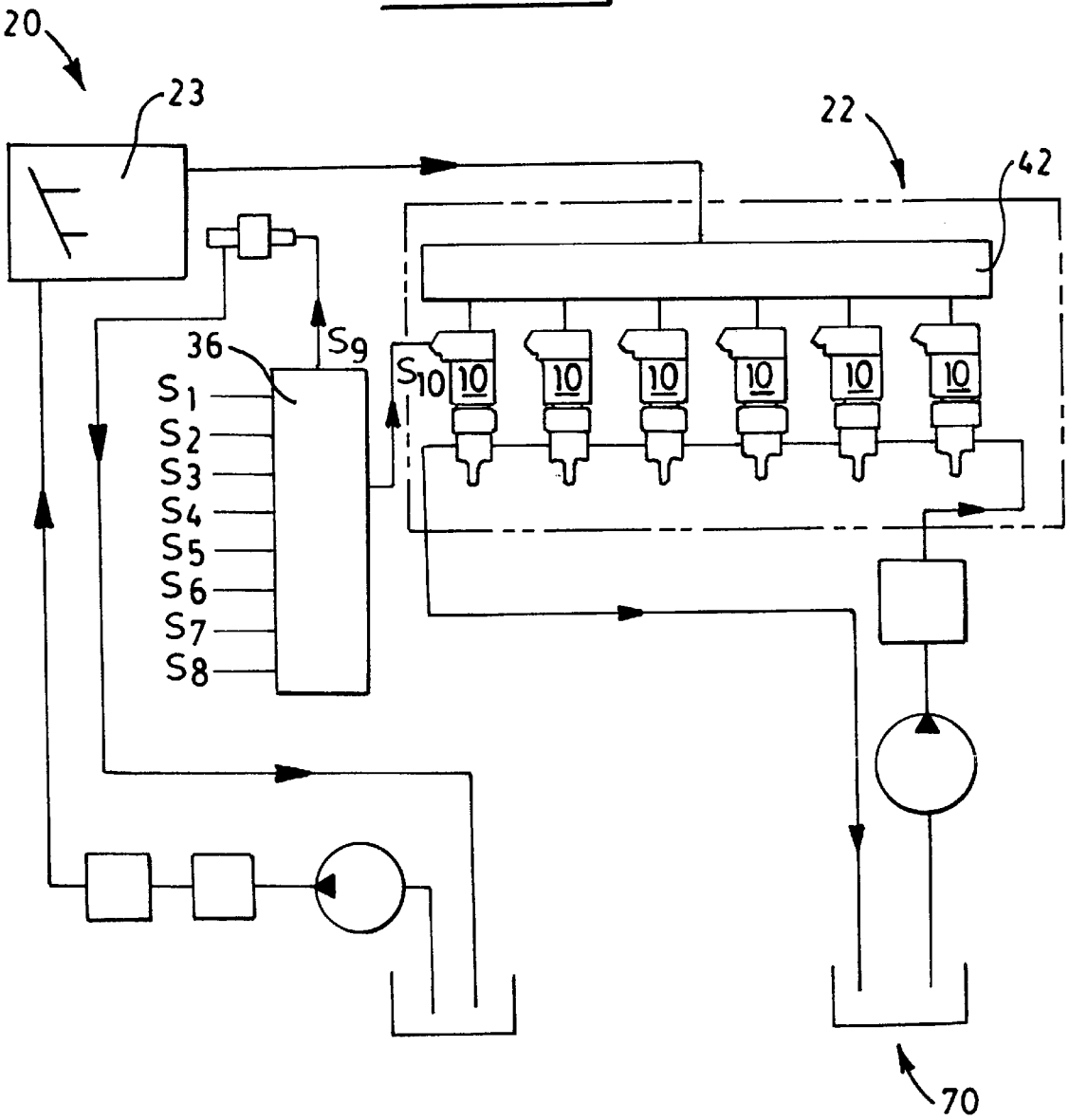
FIG. 1 is a diagrammatic general schematic view of a hydraulically-actuated electronically-controlled injector fuel system for an engine having a plurality of injectors.

Referring to FIGS. 1 though 9 wherein the same reference numerals designate the same elements or features throughout all the FIGS. 1 through 9, a fluid pumping apparatus 10, hereinafter referred to as a unit injector, has a barrel 12 defining a spill port 13 and a bore 14 with a plunger 15 disposed therein. The plunger 15 has a rate shaping opening 16 (FIG. 3), hereinafter referred to as a first opening, and a relief opening 18, hereinafter referred to as a second opening. While the unit injector 10 is disposed in a hydraulically-actuated electronically-controlled injector system 20, hereinafter referred to as a HEUI fuel injector system, it should be understood that the cavitation prevention invention is also applicable to other types of fluid pumping apparatus including, but not limited to, mechanically-actuated electronically-controlled unit injectors, mechanically-actuated mechanically-controlled unit injectors, and injection pumps used in pump-line-nozzle fuel injection systems.

The unit injectors 10 are shown in FIG. 1 as being employed with a diesel-cycle direct-injection internal combustion engine 22. While an in-line six type engine is, for example, illustrated in FIG. 1 and described herein, it should be understood that the invention is also applicable to other types of engines, such as Vee-type engines, and rotary engines, and that the engine may contain fewer or more than six cylinders or combustion chambers 22. The following description will first describe the elements and operation of the HEUI fuel injector 10 and then will describe in more detail specifics of the inventive embodiments of the second opening 18.

Figure 2:
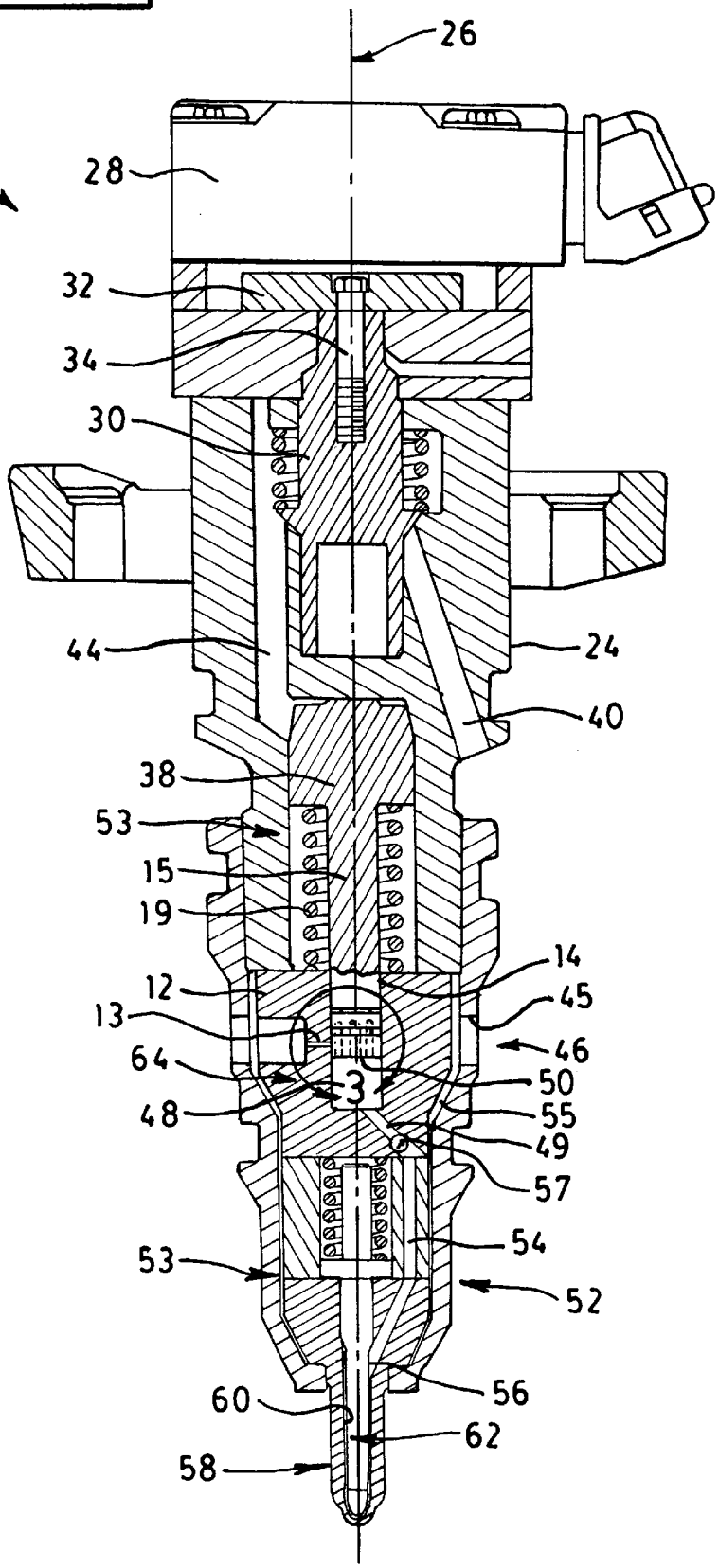
FIG. 2 is a diagrammatic isolated enlarged cross-sectional view of a first embodiment of the present invention applied to a hydraulically-actuated injector shown in FIG. 1.

An exemplary fuel injector such as the HEUI fuel injector is shown in FIG. 2. The fuel injector 10 has an injector body 24 with a longitudinal axis 26. A solenoid actuator 28 is mounted over an upper end portion of the injector body 24. A poppet valve 30 is slidably disposed in the body 24 and operably moveable between a first (non-injection, downward seated) position and a second (injection, upward seated) position. The solenoid actuator 28 operably displaces the poppet valve 30 between the first position and the second position in response to electronic signals sent to the solenoid 28 by an electronic control module 36 (FIG. 1).

An intensifier piston 38 is slidable disposed in the body 24. A hydraulic fluid inlet passage 40 communicates highly pressurized hydraulic fluid to the poppet valve 30 from a high pressure manifold 42 (FIG. 1). An internal hydraulic fluid passage 44 communicates hydraulic fluid to the intensifier piston 38 from the poppet valve 30 when in its second (upward) position.

A lower end portion of the injector body 24 is mounted on the upper end of a barrel assembly 46. A reciprocatable fuel pump plunger 15, hereinafter referred to as the plunger, extends downward from the piston 38 into an axial bore 14 defined by the barrel 12. The intensifier piston 38 is hydraulically actuated and engages the plunger 15 on an actuation end portion 53. A fluid compression chamber 48 is defined by a compression end 50 of the plunger 15 and a lower portion of the bore 14.

Beneath the barrel assembly 46 is the nozzle assembly 52. The internal fuel passage 54 communicates fuel from the compression chamber 48 to the cardioid chamber 56. A nozzle spray tip 58 is located at the lower end portion of the nozzle assembly 52 and defines an elongated cavity 60. A needle check 62 is slidably disposed within the elongated cavity 60 and moveable between a first (downward seated, non-injection) position and a second (upward lifted, injection) position.

Referring now to FIGS. 3 through 9 the cavitation control means 64 are shown. The cavitation control means 64 includes at least one of both a spill control means 66 and a cavitation prevention means 68. The spill control means 66 includes at least one port 13 defined in the barrel 12 and the first opening 16 defined in the reciprocatable plunger 15 for intermittently communicating a portion of fuel from the compression chamber 48 with the port 13 at a spill end 17 while the plunger 15 moves in direction A, hereinafter referred to as the pumping stroke. Further details of the spill control means 66, not discussed here, are disclosed in U.S. Pat. No. 5,492,098 issued to Hafner et al. on Feb. 20, 1996.

Figure 3:
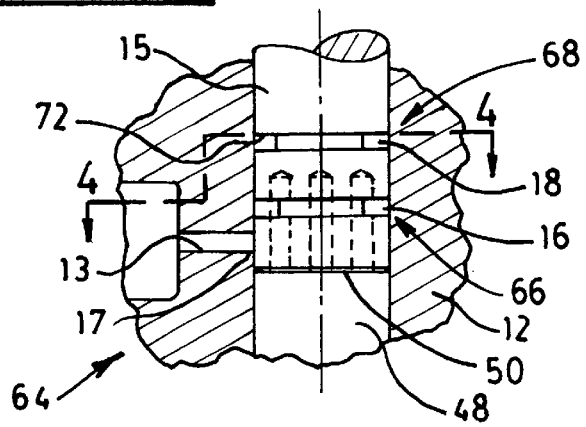
FIG. 3 is diagrammatic enlarged partial view of the plunger and barrel assembly taken within encircling line 3 of FIG. 2.
Figure 4:
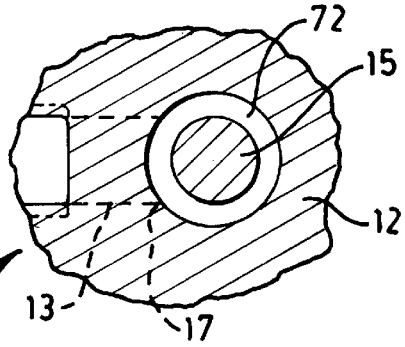
FIG. 4 is a diagrammatic cross-sectional view taken along line 4—4 of FIG. 3.

Referring to FIGS. 2 through 4 a first embodiment of the cavitation prevention means 68 is shown in a detail of the cavitation control means 64. The cavitation prevention means 68 includes a port 13 defined in the barrel 12 and the second opening 18 defined in the reciprocatable plunger 15 for intermittently communicating a portion of fuel from the port 13 at the spill end 17 with the second opening 18 during the pumping stroke of the plunger 15.

The port 13 of the barrel 12 intersects the bore 14 of the barrel 12 in which the plunger 15 reciprocates at the spill end 17. The port 13 also communicates with relatively low pressure fuel supply means 70 (FIG. 1). Preferably, the port 13 of the barrel 12 has a rectangular cross-sectional area and is arranged so that the longest sides of the rectangle are positioned perpendicular to the reciprocal motion of the plunger 15 to ensure the spill end 17 is rapidly uncovered by the first opening 16 and the second opening 18 of the plunger 15. While this is the preferred geometry and orientation it is to be understood that the port 13 may be of other various cross-sectional shapes and orientations.

In the first embodiment of FIGS. 2 through 4 the second opening 18 in the plunger 15 is defined by an outer circumferential or annular slot 72 encircling the plunger 15 which is preferably cylindrical in shape. The axial distance between the compression end 50 and the annular slot 72 is predetermined and controls a cavitation pressure during the pumping stroke of the plunger 15.

Figure 5:
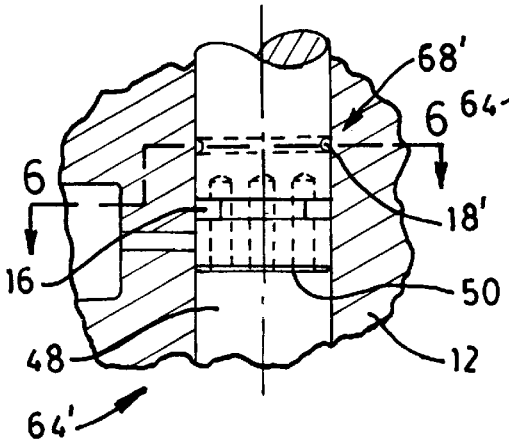
FIG. 5 is a diagrammatic view similar to FIG. 3 but showing a second embodiment of the present invention.
Figure 6A:
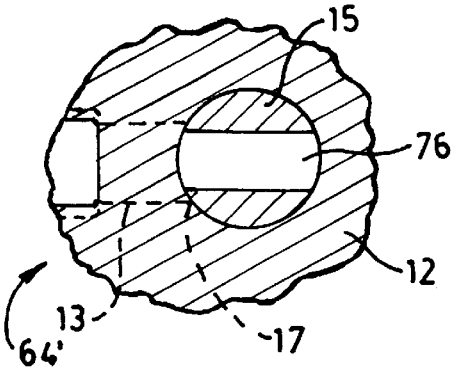
FIG. 6A is a diagrammatic cross-sectional view taken along line 6—6 of FIG. 5.

Referring to FIGS. 5 through 6A a second embodiment of the cavitation prevention means 68' is shown in a detail of the cavitation control means 64'. The cavitation prevention means 68' is similar to the first embodiment of FIGS. 2 through 4 except that the second opening 18' includes a cross-hole 76 through the diameter of the plunger 15.

Figure 6B:
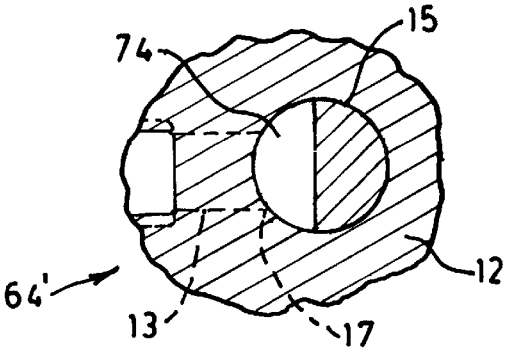
FIG. 6B is a diagrammatic cross-sectional view similar to those shown in FIGS. 4 and 6A, but showing a third embodiment of the invention.

FIG. 6B illustrates a third embodiment similar to the first and second embodiments, except that the second opening 18 in the plunger 15 is a notch 74 that can be cut into or otherwise formed in the plunger 15. It will be understood, of course, that while only an annular groove 72, cross-hole 76, and notch 74 are illustrated, the invention can be practiced using a suitable slot of any shape.

Industrial Applicability

In operation, a high pressure fluid pump 23 supplies fluid to the hydraulic fluid inlet passage 40 through a fluid rail or manifold 42 defined in an engine cylinder head. A hydraulic fluid enters the fluid inlet passage 40 at a pressure from about 4 to 23 MPa (about 580 to 3300 psi). The poppet valve 30, in the first (downward) position, blocks the further advance of the pressurized fluid into the injector body 24, and keeps the internal hydraulic fluid passages 44 filled with hydraulic fluid at a relatively lower fluid pressure.

An electronic signal from the electronic control module 36 causes the solenoid actuator 28 to move the poppet valve 30 to a second (upward) position. When the poppet valve 30 moves to the second position, the pressure of the fluid in the internal hydraulic fluid passage 44 rapidly increases to that of the fluid in the inlet passage 40 almost instantly. The pressure of the hydraulic actuating fluid acts against the intensifier piston 38, forcing it and the plunger 15 downward.

A low pressure fuel supply 70 provides fuel to the injector through the inlet opening 45. The fuel is housed in a fluid chamber 55 defined by the barrel 12 and a nozzle housing 53 and communicates with a compression chamber 48 through a ball valve 57 and a compression chamber passage 49. Fuel is pressurized in the compression chamber 48 as the plunger 15 moves downward and high pressure fuel travels though the compression chamber passage 49, passing the ball valve 57 to an internal fuel passage 54 and ultimately reaching a cardioid chamber 56. This high pressure fluid build up in the cardioid chamber 56 moves a needle check 62 into its second (upward, unseated) position allowing fuel to spray from a nozzle spray tip 58.

Figure 7:
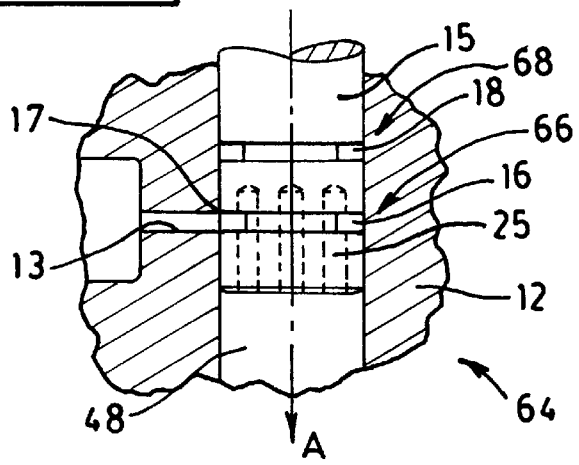
FIG. 7 is a diagrammatic view similar to FIG. 3 showing a first position of the plunger 15 during its pumping stroke.

FIGS. 7 though 9 show the operation of the first embodiment of the cavitation control means 64 shown in FIGS. 2 through 3. When the plunger 15 is fully retracted, as shown in FIG. 3, the first or leading land of the plunger 15 covers the spill end 17 of the port 13. Referring to FIG. 7, as the plunger 15 moves in direction A, on its pumping stroke, the first opening 16 of the plunger 15 temporarily or intermittently communicates with the spill end 17 so that a portion of the high pressure fuel in the compression chamber 48 is spilled into the port 13 through the spill end 17 via a passage means 25 of the plunger 15. Further details of the spill control means 66, not discussed here, are disclosed in U.S. Pat. No. 5,492,098 issued to Hafner et al. on Feb. 20, 1996.

Figure 8:
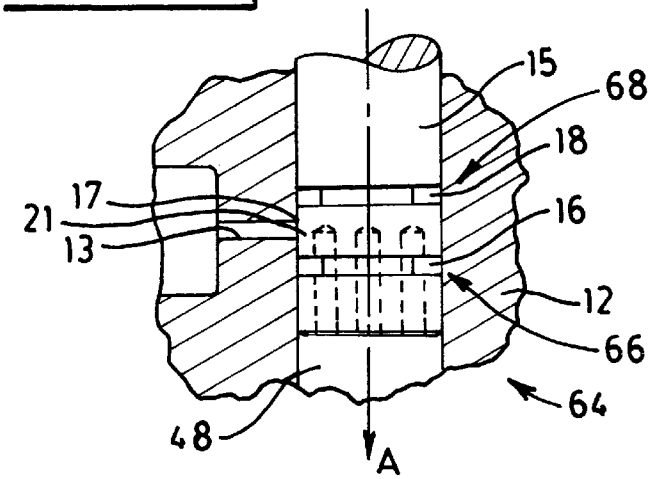
FIG. 8 is a diagrammatic view similar to FIG. 3 showing a second position of the plunger 15 during its pumping stroke.

Referring to FIG. 8, as the plunger 15 continues moving in direction A the second or intermediate land 21 of the plunger 15 blocks the spill end 17 of the port 13 and the first opening 16 no longer communicates with the port 13. The high pressure fuel spilled by the first opening 16 continues traveling further into the port 13 resulting in very low or even vacuum pressures at the spill end 17 and propagating a pressure wave in the port 13, allowing bubbles to form at the spill end 17. The pressure wave in the spill port 13 reflects back to the spill end 17 of the port 13 in response to the vacuum pressures developed at the spill end 17.

Figure 9:
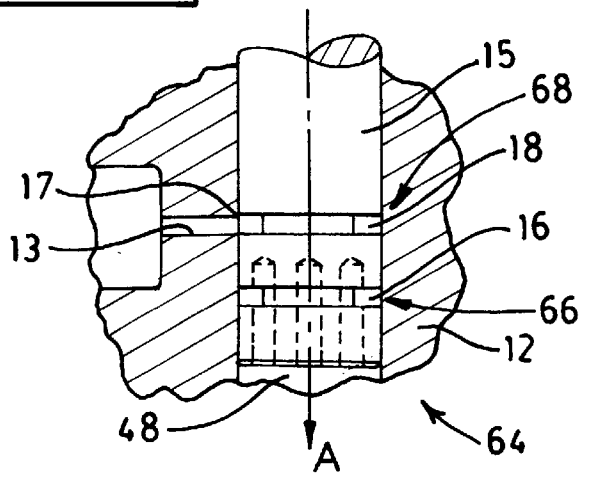
FIG. 9 is a diagrammatic view similar to FIG. 3 showing a third position of the plunger 15 during its pumping stroke.

Referring to FIG. 9, as the plunger 15 continues moving in direction A, the second opening 18 of the plunger 15 temporarily or intermittently communicates with the spill end 17 so that a portion of the high pressure fuel in the port 13 is spilled into the second opening 18 of the plunger 15. Axial placement of the second opening 18 is predetermined such that during the plunger's 15 motion in direction A the second opening 18 aligns with the spill end 17 of the spill port 13 at such a time when the pressure at the spill end 17 is at its greatest. The predetermined location of the second opening 18 is a function of the rate at which the pressure wave propagates in the spill port 13 away from and, after reflection, toward the bore 14.

As previously mentioned, the spill control means 66 alone, in some instances results in adverse effects on the structural components, especially at the spill end 17 of the port 13.

The present invention provides a means for reducing those adverse effects by creating a volume of fluid for the reflected pressure wave to disperse into when the pressure is at its highest at the spill end 17, thereby relieving the magnitude of pressure experienced at the spill end 17 and preventing the damaging collapsing of the bubbles created by the vacuum pressures at the spill end 17.

Figure 10:
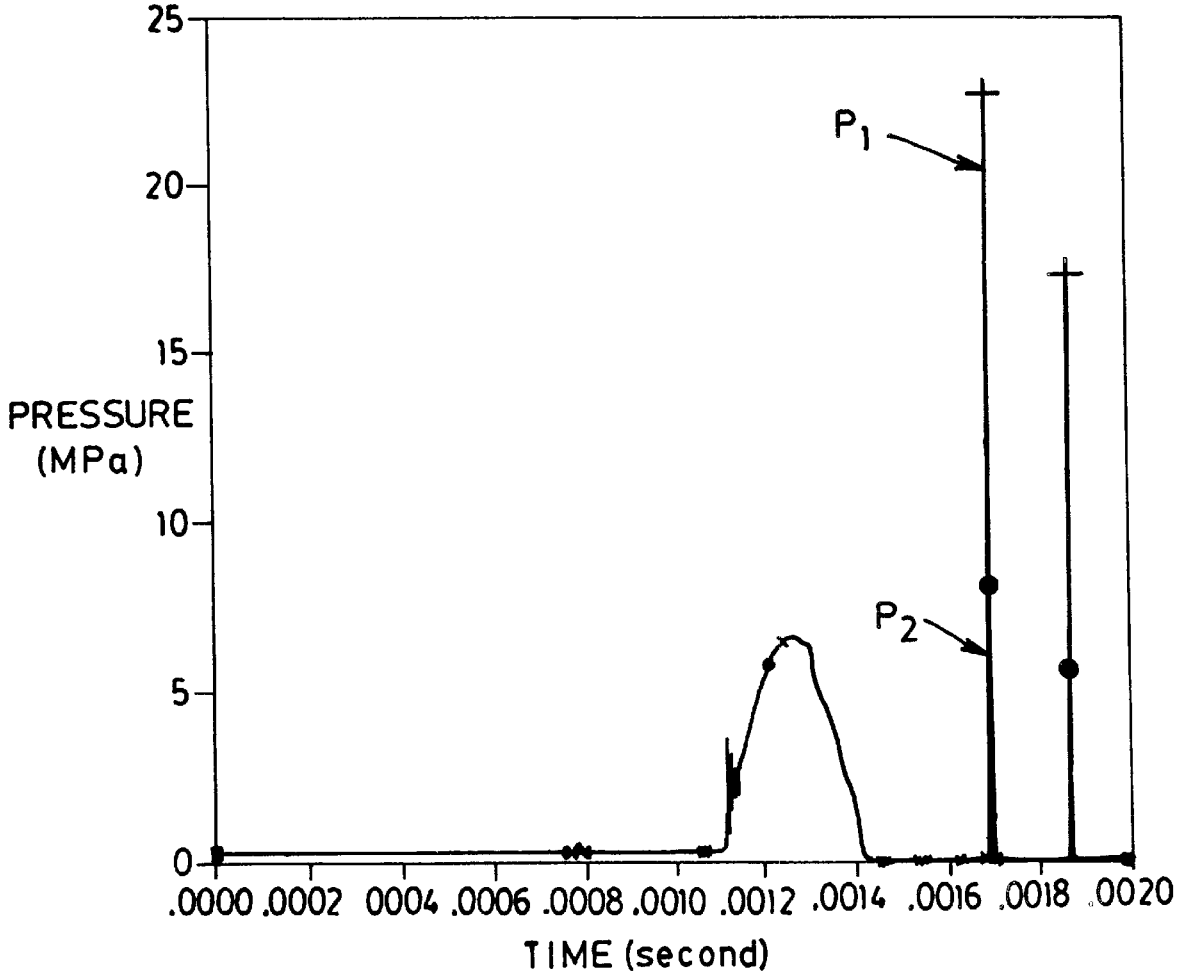
FIG. 10 is a diagrammatic graph which shows comparative results from a computer model simulation measuring pressure (MPa) versus time (seconds). Curve $P_1$ shows the maximum pressure reached at the spill end 17 of the spill port 13 in an injector without the present invention. Curve $P_2$ shows the maximum pressure reached at the spill end 17 of the spill port 13 in an injector with the present invention.

FIG. 10 is a diagrammatic graph which shows comparative results from a computer model simulation measuring pressure (MPa) versus time (seconds). Curve $P_1$ shows (with the "+" on the vertical line) the maximum pressure reached at the spill end 17 of the spill port 13 in an injector utilizing a plunger 15 with only a first opening 16. Curve $P_2$ shows (with the dot on the vertical line) the maximum pressure reached at the spill end 17 of the spill port 13 in an injector having the first embodiment of the cavitation control means 64 shown in FIGS. 2–4. While the $P_1$ and $P_2$ "curves" appear as vertical lines, it is to be understood that the "curves" are, in fact, curves which have a very short time duration from the initiation of pressure buildup until it is returned to "system" pressure levels. A subsequently occurring $P_1/P_2$ curve is shown about .0002 seconds later with the $P_1$ and $P_2$ values indicated as in the first occurring $P_1/P_2$ curve. Such curves continue because of repeated pressure wave reflection in the fuel system components for much of the injection cycle albeit with ever decreasing valves of $P_1$ and $P_2$. With additional optimization of the plunger/barrel configuration it is believed that even lower maximum pressures are achievable. Pressure is measured in Mega Pascal (MPa) and time is measured in seconds. The models simulate an injector running at a rail pressure of 21 MPa.

Other aspects, objects and advantages of this invention can be obtained from a study of the drawings, the disclosure and the appended claims.

I claim:

1. A fluid pumping device, comprising:

a barrel comprising an axial bore defining a longitudinal axis and having a bore wall comprising a spill port, the barrel further comprising a spill volume fluidly exposed to the bore at the spill port;

a compression chamber partially defined by the bore wall for compressing a fluid; and a plunger slideably disposed in the bore, the plunger comprising a compression surface at a compression end of the plunger, the compression surface partially defining the compression chamber, the plunger farther comprising a guide surface surrounding the longitudinal axis and slideably disposed against the bore wall, the guide surface comprising a rate shaping opening axially spaced from the compression end by a first spacing, the guide surface further comprising a relief opening axially spaced from the rate shaping opening, the plunger further comprising a passage fluidly exposed to the bore wall at the rate shaping opening and in fluid communication with the compression chamber, the plunger further comprising a wave dispersing volume fluidly exposed to the bore wall at the relief opening and not in fluid communication with the compression chamber, such that the plunger can be made to reciprocally slide within the bore between a first position at which the spill port is aligned with the rate shaping opening, putting the spill volume in fluid communication with the compression chamber, and a second position different from the first position at which the spill port is aligned with the relief opening, putting the spill volume in fluid communication with the wave dispersing volume.

2. The device of claim 1, wherein the relief opening and the wave dispersing volume are comprised by an annular slot disposed around the plunger.

3. The device of claim 1, wherein the relief opening and the wave dispersing volume are comprised by a cross-hole transversely disposed through the plunger.

4. The device of claim 1, wherein the relief opening and the wave dispersing volume are comprised by a notch in the plunger.

5. The fluid pumping device of claim 1, wherein the rate shaping opening and the relief opening are axially spaced such that while pumping is taking place a pressure wave generated by intermittent fluid communication between the compression chamber and the spill volume:

enters the spill volume when the plunger is in the first position;

reflects within the spill volume as the plunger is traveling between the first position and the second position; and is conducted from the spill volume into the wave dispersing volume when the plunger is in the second position.

6. A method for injecting fuel using a unit injector comprising a barrel, a plunger, and a compression chamber, the barrel having an axial bore defining a longitudinal axis and a bore wall comprising a spill port, the barrel further comprising a spill volume fluidly exposed to the bore at the spill port, the plunger slideably disposed in the bore, the plunger comprising a compression surface at a compression end of the plunger, the compression chamber being at least partially defined by the bore wall and the compression surface, the plunger further comprising a guide surface surrounding the longitudinal axis and slideably disposed against the bore wall, the guide surface comprising a rate shaping opening axially spaced from the compression end by a first spacing, the guide surface further comprising a relief opening axially spaced from the rate shaping opening, the plunger further comprising a passage fluidly exposed to the bore wall at the rate shaping opening and in fluid communication with the compression chamber, the plunger further comprising a wave dispersing volume fluidly exposed to the bore wall at the relief opening and not in fluid communication with the compression chamber, the method comprising:

moving the plunger within the bore to a first position at which the spill port is aligned with the rate shaping opening;

passing pressurized fuel from the compression chamber through the rate shaping opening and the spill port to the spill volume when the plunger is at the first position; and moving the plunger within the bore to a second position at which the spill port is aligned with the relief opening, putting the spill volume in fluid communication with the wave dispersing volume.

7. A fluid pumping device, comprising:

a barrel comprising an axial bore defining a longitudinal axis and having a bore wall comprising a spill port, the barrel further comprising a spill volume fluidly exposed to the bore at the spill port;

a compression chamber partially defined by the bore wall for compressing a fluid; and a plunger slideably disposed in the bore, the plunger comprising a compression surface at a compression end of the plunger, the compression surface partially defining the compression chamber, the plunger further comprising passage means for putting the rate shaping opening in fluid communication with the compression chamber; and the plunger further comprising wave dispersing means, not in fluid communication with the compression chamber, for receiving a reflected pressure wave, such that the plunger can be made to reciprocally slide within the bore between a first position that puts the spill volume in fluid communication with the compression chamber and a second position different from the first position that puts the spill volume in fluid communication with the wave dispersing means to disperse the reflected pressure wave.

8. The device of claim 7, wherein the wave dispersing means comprises an annular slot disposed around the plunger.

9. The device of claim 7, wherein the wave dispersing means comprises a cross-hole transversely disposed through the plunger.

10. The device of claim 7, wherein the wave dispersing means comprises a notch in the plunger.

11. The fluid pumping device of claim 7, configured such that while pumping is taking place, a pressure wave generated by intermittent fluid communication between the compression chamber and the spill volume:

enters the spill volume when the plunger is in the first position;

reflects within the spill volume as the plunger is traveling between the first position and the second position; and is conducted from the spill volume to the wave dispersing means when the plunger is in the second position.

* * * * *